United States Patent [19]

Gasser et al.

[11] 4,361,006

[45] Nov. 30, 1982

[54] SPINNING FRAME

[75] Inventors: Hermann Gasser, Zürich; Karl Curiger, Pfäffikon; Peter Novak, Winterthur, all of Switzerland

[73] Assignee: Luwa AG, Zürich, Switzerland

[21] Appl. No.: 164,068

[22] Filed: Jun. 30, 1980

[30] Foreign Application Priority Data

Jul. 6, 1979 [CH] Switzerland ..... 6333/79

[51] Int. Cl.[3] ..... D01H 11/00

[52] U.S. Cl. ..... 57/304; 19/263

[58] Field of Search ..... 57/301, 304, 305, 308, 57/58.89; 19/245, 262–265

[56] References Cited

U.S. PATENT DOCUMENTS

| | | | |
|---|---|---|---|
| 2,425,577 | 8/1947 | Thoma | 57/304 |
| 2,720,074 | 10/1955 | Buhler | 57/304 |
| 4,006,033 | 2/1977 | Schewe | 57/58.89 X |

*Primary Examiner*—John Petrakes

*Attorney, Agent, or Firm*—Werner W. Kleeman

[57] ABSTRACT

A spinning frame having a frame mount, a plurality of spindles and, suction elements for each spindle, a ventilating fan arranged in the frame mount and connected to the suction elements, and a filter on the pressure side of the ventilating fan, the filter forming at least part of the rear wall of the frame mount, and including pneumatic cleaning means for the filter, said cleaning means including a suction arm which is movable along the filter and is connected to a suction device.

6 Claims, 3 Drawing Figures

SPINNING FRAME

CROSS REFERENCE TO RELATED CASE

This application is related to the commonly assigned copending United States Applications Ser. Nos. 6/164,066, filed June 30, 1980, 6/164,067, filed June 30, 1980, 6/164,292, filed June 30, 1980 and 6/164,321, filed June 30, 1980.

DESCRIPTION

BACKGROUND OF THE INVENTION

The invention relates to a spinning frame, particularly, though not exclusively, a flyer spinning frame.

There is known a flyer spinning frame having suction elements for each spindle, a ventilating fan and a filter. Suction elements are provided adjacent the spindles and also near drawing rollers upstream of the spindles. The suction elements, which may be air inlet ports in a housing or in suction heads, not only serve to remove dust and loose fibres, but some are also arranged to remove broken rovings. The large quantities of air required lead to relatively high flow rates at the air outlet. Troublesome draughts may thus be caused. Also, although it is advantageous for all the suction elements for each spindle to be connected to a single source of low pressure (even though they are not all as a rule operated at the same low pressure), a problem is that elements adjacent the sliver, e.g. near the rollers, must operate at least at a defined low pressure. However, even when the filter has a relatively large surface area, pressure variations occur, depending on the amount of material deposited on the filter, which are capable of adversely affecting the operating of the spinning frame.

SUMMARY OF THE INVENTION

The object of the invention is therefore to provide a spinning frame, in which more uniform flow rates and a more uniform pressure drop at the filter can be achieved despite there being present great quantities of air.

According to the present invention there is provided a spinning frame having a frame mount, a plurality of spindles and, suction elements for each spindle, a ventilating fan arranged in the frame mount and connected to the suction elements, and a filter on the pressure side of the ventilating fan, the filter forming at least part of the rear wall of the frame mount, and including pneumatic cleaning means for the filter, said cleaning means including a suction arm which is movable along the filter and is connected to a suction device.

With the invention, a large cross-section is provided for an outlet orifice from the frame so that acceptable flow rates are set. The filter can be cleaned in such a manner that considerably reduced pressure variations occur.

BRIEF DESCRIPTION OF THE DRAWINGS

The invention will be more clearly understood from the following description, given by way of example only, with reference to the accompanying drawings in which.

DETAILED DESCRIPTION OF THE PREFERRED EMBODIMENTS

Figure 1:
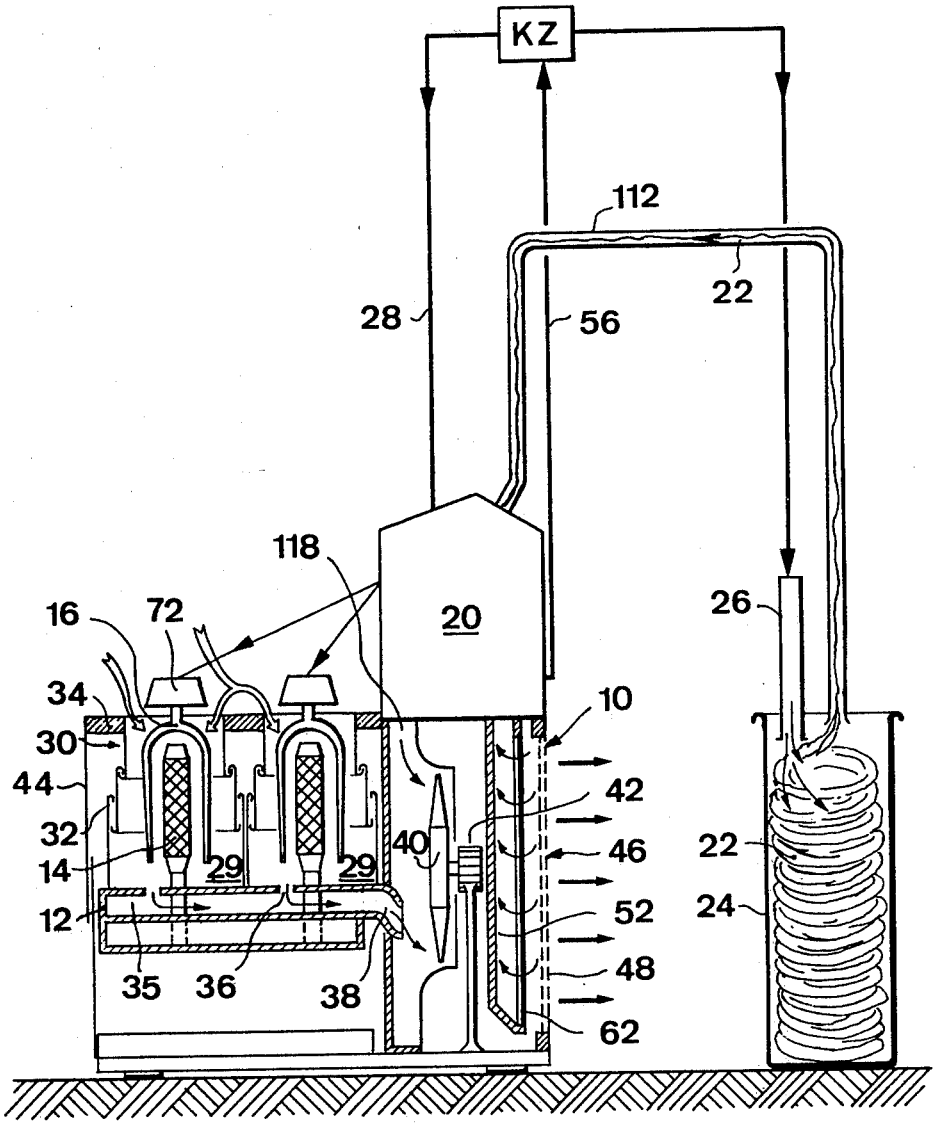
FIG. 1 shows a flyer spindle frame in diagrammatic cross-section.
Figure 3:
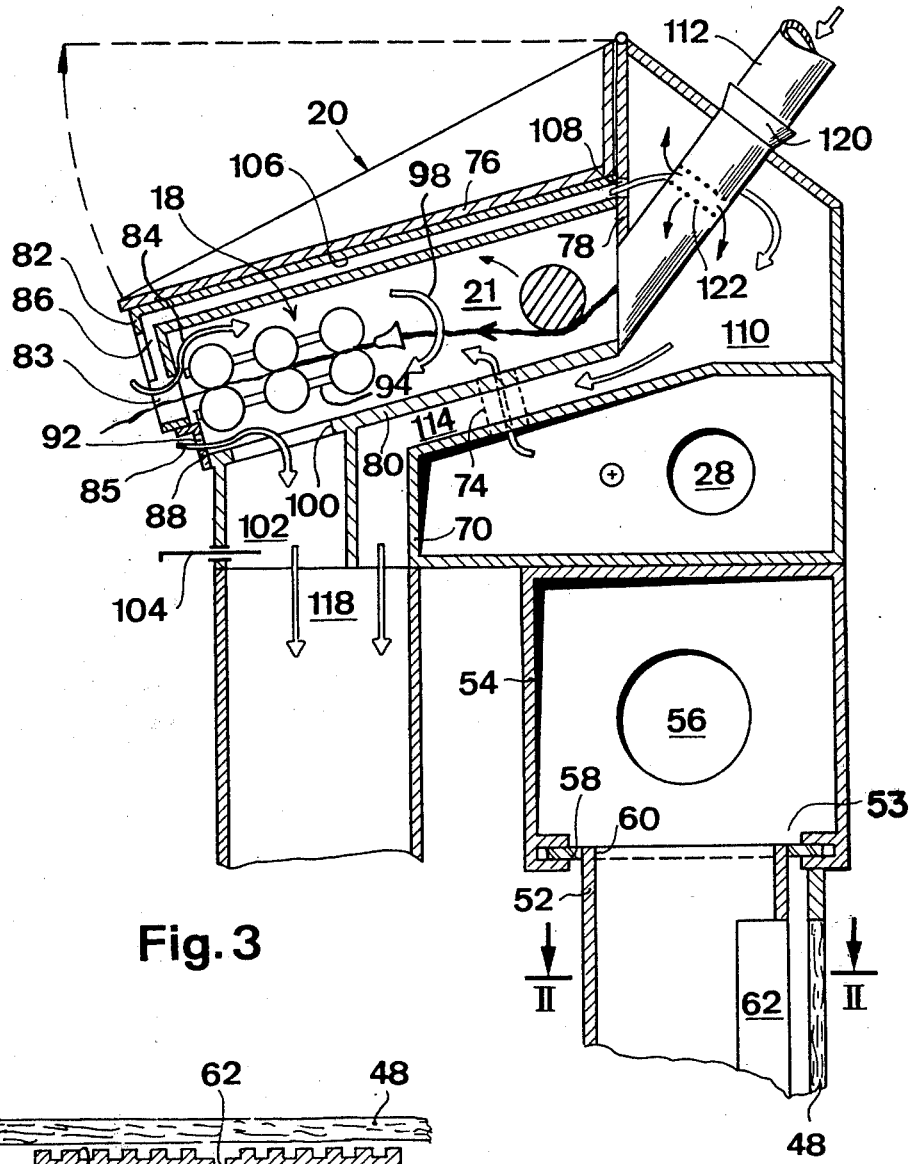
FIG. 3 shows, on an enlarged scale, part of the frame of FIG. 1.

Generally designated at 10 in FIG. 1 is a flyer spinning frame which comprises a spindle rail 12, a plurality of spindles of which two are shown at 14 and drawing rollers 18 of a drawing frame shown in FIG. 3 and located in a drawing zone generally designated at 20 in the Figures. Cans 24, one of which is shown, are filled with a draw sliver 22 to be processed. Conditioner air is fed from an air-conditioning unit KZ through pipes 26 and 28 to the cans 24 and the flyer spinning frame 10.

As shown in FIG. 1, each of the spindles 14 is arranged, together with its flyer 16, in a separate chamber 29. The chambers 29 are delimited by approximately circular sleeves 30 each formed by a plurality of rings 32 which can be moved telescopically within one another. The sleeves 30 are open at the top and their axial length can be varied according to the lift of the spindle rail 12. The lowest ring 32 of each sleeve 30 is attached in airtight manner to the spindle rail 12 which has a duct section 35 for each sleeve 30 or, as shown, each adjacent pair of sleeves. The upper side of the duct section 35 has an inlet orifice 36 located inside the corresponding ring 32. The duct sections in the spindle rail 12 and therefore the chambers 29, that is the sleeves 30, are in turn connected by flexible tubes 38 to the suction side of a ventilating fan 40 which is driven by a motor 42.

The rings of the sleeves 30 are each secured in a common support or retaining frame 34 which is vertically movable, but which is kept stationary during operation of the flyer spinning frame 10. A telescopic covering shutter 44 extends down from the front edge of the retaining frame 34 to the spindle rail.

The rear wall 46 of the flyer spinning frame 10 is at least partially formed by a filter 48 which comprises a large proportion of the wall and through which air from the delivery side of the ventilating fan 40 flows into the spinning room.

Figure 2:
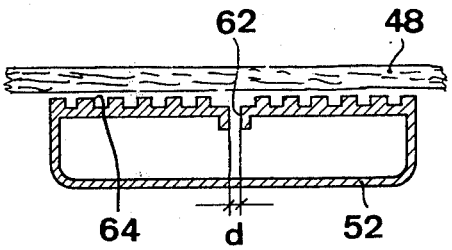
FIG. 2 is a section along line II—II in FIG. 3.

In order to remove dust and fibres from the filter 48, there are pneumatic cleaning means comprising a suction arm 52 which is movable along the inside of the filter 48. The suction arm 52 leads into an air duct 54 (FIG. 3) which extends along the flyer spinning frame 10 adjacent the rear wall 46. The air duct 54 is connected by a line 56, and preferably via a pressure reducing means, to the suction side of the air-conditioning unit KZ. Part of the bottom of the air duct 54 consists of a flexible band 58 defining a wall thereof and which is movable in the longitudinal direction of the duct 54 and which covers a longitudinal slot 53 in the bottom of the duct 54. The band 58 is reciprocated by a suitable drive (not shown). The suction arm 52 is attached to the band 58, the interior of the suction arm 52 being connected via an orifice 60 to the duct 54 for admission of air thereto. As shown in FIGS. 1 and 2, the suction arm 52 has a longitudinal suction slot 62 having a width d, this slot extending over the entire height of the filter 48. Preferably, and as shown in FIG. 2, the cross-section of the suction arm 52 is rectangular, and on both sides of the suction slot 62 and adjacent to the surface of the filter 48 there are sealing baffles 64, which cause air to flow into the suction arm through the filter 48 from its clean air side. The overall width of the suction arm 52 in its direction of movement, is preferably several times greater than d in order to achieve an effective sealing and prevent the lateral admission of suction air.

In FIG. 3 the drawing zone 20 is shown in detail and on an enlarged scale compared with FIG. 1.

Sets of drawing rollers 18, of which one is shown, are supported in a manner not shown in detail, above an air duct 70 which extends, adjacent to the rear wall 46, along the flyer spinning frame 10 at about the height of upper bearings 72 of the flyers 16. An end of this duct 70 is connected to the air-conditioning unit KZ by a pipe 28 so that conditioned air is fed to the duct. The drawing zone of each set of drawing rollers 18 is connected to the duct 70 by an offset duct 74 so that drawing of the fibres takes place in an air-conditioned atmosphere.

In the zone 20 is a casing 21 defined at the top by a hinged lid 76, at the rear by a wall 78 and at the bottom by the wall 80 through which the offset ducts 74 pass. The front of the casing is formed by a wall section 82, which is attached to the lid 76 and which has for each roving an opening 83 which serves as an inlet orifice for admitting cleaning air to the upper drawing rollers (arrow 84). The wall section 82 also contains an inlet orifice 86 for the removal, by suction of any broken sliver or roving through an air line 106. The remaining part of the front of the casing is formed by a wall 88 which can be swung forwards and downwards and which contains an inlet orifice 92 for admitting cleaning air as indicated by arrow 85 to the delivery rollers, that is the outlet rollers of the drawing frame.

Strippers associated with the drawing rollers to remove fibres therefrom, and wich are not shown, are subjected to the streams of air which flow in the directions of the arrows 84, 85 and which also convey the stripped fibres. Between the drawing rollers there are provided baffles 94 which at least partly prevent the downward passage of air from the stream designated by the arrow 84 between the rollers. As a result, the greater part of the cleaning air sucked through the opening 83 passes to the rear of the casing 21, over the upper drawing rollers, around the intake rollers of the drawing frame and forward again under the lower drawing rollers, as shown by arrow 98. This cleaning air, together with the air (arrow 85) which has been admitted through the orifice 92, then flows through an orifice 100 in the wall 80 into a duct 102 which leads to the ventilating fan 40 via a duct 118. In the duct 102 there is provided an adjustable shutter 104 with which it is possible to control the quantity of air flowing therein.

For removing broken slivers or rovings by suction there is provided, in addition to the air line 106 extending through the hinged lid 76, an orifice 108 in the wall 78 of the casing, which is also a wall of a housing 110 arranged above the duct 70. The housing 110 is connected by a duct 114 to the ventilating fan 40, again via the duct 118.

Leading into the rear wall 78 of the casing 21 is a conveying tube 112 for a sliver to be processed, which leads from the can 24. It will be appreciated that the connections between the ventilating fan 40 and, firstly, the interior of the casing 21 and, secondly, the interior of the housing 110, extend initially separately from one another before being combined in duct 118 so that it is possible to set different pressures in these region, for example, to set a lower pressure in the housing 110 than in the casing 21.

Where the tube 112 enters the housing 110, there is an injector 120 for feeding in the sliver. Where it extends through the housing 110, the conveying tube 112 has outlet orifices 122 for the conveying air which can therefore be at least partially removed before the sliver emerges from the conveying tube into the chamber of the casing 21.

In order to operate the flyer spinning frame 10, the draw sliver 22 in the can 24 is placed near the opening of the conveying tube 112 which is located near to the can, and the injector 120 is operated for a short period. This results in the sliver 22 being conveyed into and through the conveying tube 112 and passed as far as the intake rollers of the drawing frame 18. It can then be fed in by hand and subsequently threaded into the flyer. During operation of the frame, conditioned air passes through the pipe 26 into the can 24 so that it is possible to achieve pre-conditioning of the sliver, which helps in subsequent processing, particularly drawing. Conditioned air is also passed through the pipe 28, the duct 70 and the offset passages 74 to the drawing rollers 18 so that the most favourable conditions for processing the sliver occur also at these points. Meanwhile, the ventilating fan 40 causes the conveying air which carries the sliver from the can 24 to be sucked through the conveying tube 112, and this continually carries the sliver from the can 24 to the drawing rollers 18. It is, in fact possible to feed conditioned air only to the drawing rollers, rather than to the can as well. This has the advantage of a longer time of air residence at the drawing zone which can be particularly important in the case of higher sliver speeds and correspondingly short residence times between the drawing rollers.

The conveying air flows from the tube 112 through the orifices 122 into the housing 110, and passes through the ducts 114 and 118 to the ventilating fan 40. The air for cleaning the drawing rollers 18 flows into the casing through the openings 83 and the orifices 92 around the delivery rollers, flows around the strippers and finally passes, together with the initially conditioned air stream from the duct 114, through the duct 118 to the ventilating fan 40. The air which is sucked through the orifices 86 into the line 106 for removing broken rovings by suction also flows into the housing 110 and through the ducts 114 and 118 to the ventilating fan 40.

When the supporting frame 34 and the sleeves 30 are lowered upon filling of the bobbins, so as to allow replacement with empty bobbins, the sleeves 30 and the covering shutter 44 telescope, and the bobbins mounted on the spindles 14 become accessible. Meanwhile ambient air is still sucked from above through the sleeve 30 in the direction of the double arrows of FIG. 1. This suction air also conveys dust released from the bobbin presser, and it passes through the air-conducting elements in the spindle rail 12 to the ventilating fan 40, to be blown out therefrom into the spinning room through the filter 48. The dust deposit or the like forming on the filter 48 from this and other sources is removed by the moving suction arm 52 and fed via the duct 54 and the line 56 to the air-conditioning unit KZ and collected therein.

As the filter 48 extends over a major part of length of the frame, and over a considerable part of the rear wall, a large surface area is provided to clean the air without a significant loss of pressure. The air is ejected at a comparatively low velocity.

While there are shown and described present preferred embodiments of the invention, it is to be distinctly understood that the invention is not limited thereto, but may be otherwise variously embodied and practiced within the scope of the following claims. Accordingly,

What we claim is:

1. A spinning frame containing spindles and comprising:

a frame mount;

a ventilating fan arranged in cooperating relationship with respect to said frame mount and the spindles of the spinning frame;

said ventilating fan having a suction side and a pressure side;

a filter located at the pressure side of said ventilating fan;

said filter forming at least part of a rear wall of said frame mount;

pneumatic cleaning means provided for said filter;

said pneumatic cleaning means comprising:

a suction arm which is movable along said filter; and a suction device connected to said suction arm; and said movable suction arm overlying a portion of the filter which is being cleaned and diminishing the action of the ventilator fan upon the filter, so that waste deposited upon said filter is effectively entrained away from said filter by the action of the cleaning means.

2. The spinning frame as defined in claim 1, further including:

an air duct operatively connected with said suction device;

said frame mount having a rear wall;

said air duct extending in longitudinal direction adjacent said rear wall of said frame mount;

said air duct having a longitudinally movable part;

said suction arm being operatively connected to said longitudinally movable part; and said longitudinally moving part constituting a portion of a wall of said air duct.

3. The spinning frame as defined in claim 2, wherein:

said longitudinally movable part comprising a flexible band;

said wall of said air duct having a longitudinal slot; and said longitudinally movable part to which there is connected said suction arm covering said longitudinal slot.

4. The spinning frame as defined in claim 1, further including:

a longitudinal suction slot provided in said suction arm; and sealing baffles provided to both sides of said suction slot and extending adjacent and towards a surface of said filter.

5. A spinning frame containing spindles and comprising:

a frame mount;

a ventilating fan arranged in cooperating relationship with respect to said frame mount and the spindles of the spinning frame;

said ventilation fan having a suction side and a pressure side;

a filter located at the pressure side of said ventilating fan;

said filter forming at least part of a rear wall of said frame mount;

pneumatic cleaning means comprising:

a suction arm which is movable along said filter; and a suction device connected to said suction arm;

an air duct operatively connected with said suction device;

said frame mount having a rear wall;

said air duct extending in longitudinal direction adjacent said rear wall of said frame mount;

said air duct having a longitudinally movable part;

said suction arm being operatively connected to said longitudinally movable part; and said longitudinally moving part constituting a portion of a wall of said air duct.

6. A spinning frame containing spindles and comprising:

a frame mount;

a ventilating fan arranged in cooperating relationship with respect to said frame and the spindles of the spinning frame;

said ventilating fan having a suction side and a pressure side;

a filter located at the pressure side on said ventilating fan;

said filter forming at least part of a rear wall of said frame mount;

pneumatic cleaning means provided for said filter;

said pneumatic cleaning means comprising:

a suction arm which is movable along said filter; and a suction device connected to said suction arm;

a longitudinal suction slot provided in said suction arm; and sealing baffles provided to both sides of said suction slot and extending adjacent and towards a surface of said filter.

* * * * *